US011309641B2

(12) United States Patent
Ito et al.

(10) Patent No.: US 11,309,641 B2
(45) Date of Patent: Apr. 19, 2022

(54) ANTENNA AND WIRELESS MODULE

(71) Applicant: Murata Manufacturing Co., Ltd., Kyoto (JP)

(72) Inventors: Yuichi Ito, Kyoto (JP); Masahiro Izawa, Kyoto (JP); Masayuki Kobayashi, Kyoto (JP); Nobumitsu Amachi, Kyoto (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 135 days.

(21) Appl. No.: 16/251,618

(22) Filed: Jan. 18, 2019

(65) Prior Publication Data

US 2019/0157773 A1 May 23, 2019

Related U.S. Application Data

(63) Continuation of application No. PCT/JP2017/026932, filed on Jul. 25, 2017.

(30) Foreign Application Priority Data

Jul. 26, 2016 (JP) ..... JP2016-146719

(51) Int. Cl.
*H01Q 1/38* (2006.01)
*H01Q 23/00* (2006.01)
(Continued)

(52) U.S. Cl.
CPC ..... *H01Q 23/00* (2013.01); *H01Q 1/38* (2013.01); *H01Q 1/48* (2013.01); *H01Q 5/328* (2015.01);
(Continued)

(58) Field of Classification Search
CPC ..... H01Q 23/00; H01Q 1/38; H01Q 5/328; H01Q 19/30; H01Q 1/48; H01Q 5/335; H01Q 9/0407
See application file for complete search history.

(56) References Cited

U.S. PATENT DOCUMENTS

2002/0105471 A1* 8/2002 Kojima ..... H01Q 19/32 343/749
2006/0232492 A1 10/2006 Sawatani
(Continued)

FOREIGN PATENT DOCUMENTS

JP 2001-189620 A 7/2001
JP 2003-249810 A 9/2003
(Continued)

OTHER PUBLICATIONS

International Search Report for International Application No. PCT/JP2017/026932 dated Oct. 17, 2017.
(Continued)

*Primary Examiner* — Dieu Hien T Duong
(74) *Attorney, Agent, or Firm* — Pearne & Gordon LLP

(57) ABSTRACT

An antenna (101) includes a grounded conductive foil (110) disposed on a module substrate (140), a first conductive foil (111), and a second conductive foil (112). The first conductive foil (111) and the second conductive foil (112) are disposed on the module substrate (140), are elongated, and do not overlap with the grounded conductive foil (110) in a plan view of the module substrate (140). The first conductive foil (111) has one end supplied with an antenna signal and the other end that is open. The second conductive foil (112) has one end connected to the grounded conductive foil (110) and the other end that is open. A wireless module (120)
(Continued)

includes a circuit unit (130) including a communication circuit and provided to the module substrate (140) on which the antenna (101) is formed.

20 Claims, 10 Drawing Sheets

(51) Int. Cl.

| | |
|---|---|
| ***H01Q 5/328*** | (2015.01) |
| ***H01Q 19/30*** | (2006.01) |
| ***H01Q 1/48*** | (2006.01) |
| ***H01Q 5/335*** | (2015.01) |
| ***H01Q 9/04*** | (2006.01) |
| ***H01Q 25/04*** | (2006.01) |

(52) U.S. Cl.
CPC ..... *H01Q 5/335* (2015.01); *H01Q 9/0407* (2013.01); *H01Q 19/30* (2013.01); *H01Q 25/04* (2013.01)

(56) References Cited

U.S. PATENT DOCUMENTS

| | | | | |
|---|---|---|---|---|
| 2008/0169984 | A1 | 7/2008 | Takagi | |
| 2008/0258979 | A1* | 10/2008 | Lin | H01Q 1/36 343/700 MS |
| 2011/0193761 | A1 | 8/2011 | Shinkai et al. | |
| 2012/0075156 | A1* | 3/2012 | Noguchi | H01Q 3/44 343/837 |
| 2012/0122414 | A1 | 5/2012 | Noguchi et al. | |
| 2015/0070235 | A1* | 3/2015 | Kashino | H01Q 1/38 343/819 |

FOREIGN PATENT DOCUMENTS

| | | | |
|---|---|---|---|
| JP | 2005-79867 | A | 3/2005 |
| JP | 2008-172672 | A | 7/2008 |
| KR | 20010073723 | A * | 8/2001 |
| WO | 2004/064194 | A1 | 7/2004 |
| WO | 2010/041436 | A1 | 4/2010 |
| WO | 2011/065020 | A1 | 6/2011 |

OTHER PUBLICATIONS

Written Opinion for International Application No. PCT/JP2017/026932 dated Oct. 17, 2017.

Richard Wallace et al., "2.4 GHz YAGI PCB Antenna", Application Note DN034, Antenna Selection Guide, 2010, Texas Instruments Incorporated.

* cited by examiner 113
114
112
111
110
101
140
115
130
116
Z
X
Y

ANTENNA AND WIRELESS MODULE

This is a continuation of International Application No. PCT/JP2017/026932 filed on Jul. 25, 2017 which claims priority from Japanese Patent Application No. 2016-146719 filed on Jul. 26, 2016. The contents of these applications are incorporated herein by reference in their entireties.

BACKGROUND OF THE DISCLOSURE

Field of the Disclosure

The present disclosure relates to an antenna and particularly relates to a unidirectional antenna configured on a substrate.

Description of the Related Art

To date, antennas including conductive foils on a substrate such as a printed circuit board or a ceramic multi-layer substrate have been widely used.

For example, Patent Document 1 discloses an array antenna including a dielectric substrate on which conductive foils are disposed as a feed element and parasitic elements and that is provided upright on the ground plate. According to the array antenna, the conductive foils having predetermined lengths and disposed at a predetermined interval each serve as a corresponding one of a feed element and a non-feed element, and thereby an array antenna that has wide band impedance matching characteristics and that is unidirectional is provided.

In addition, for example, Non Patent Document 1 discloses a Yagi-Uda antenna including antenna elements using conductive foils on the printed circuit board. The radiating element of the antenna includes a conductive foil functioning as a dipole antenna.

Patent Document 1: Japanese Unexamined Patent Application Publication No. 2001-189620

Non Patent Document 1: Richard Wallace and Steve Dunbar, "2.4 GHz YAGI PCB Antenna", Application Note DN034, Texas Instruments Incorporated.

BRIEF SUMMARY OF THE DISCLOSURE

Recently, to address the downsizing of a radio communication device (hereinafter, a communication device), a unidirectional antenna that is enabled to configure the whole of the antenna on one substrate and that is small is strongly desired.

However, the antenna in Patent Document 1 has a three-dimensional structure in which the dielectric substrate is provided upright on the ground plate, and thus the whole of the antenna cannot be configured on one substrate. The antenna in Non Patent Document 1 has the radiating element serving as the dipole antenna, thus needs an area for a half wavelength, and is unfavorable for downsizing.

Hence, the present disclosure provides a unidirectional antenna enabled to be configured on one substrate and in a small size and a wireless module including the unidirectional antenna.

To achieve the object described above, an antenna according to an aspect of the present disclosure includes a grounded conductive foil disposed on a substrate, a first conductive foil, and a second conductive foil. The first conductive foil and the second conductive foil elongated, are disposed on the substrate, and do not overlap with the grounded conductive foil in a plan view of the substrate. The first conductive foil has one end that is supplied with an antenna signal and the other end that is open. The second conductive foil has one end that is connected to the grounded conductive foil and the other end that is open.

With this configuration, the directivity corresponding to antenna gain caused by the first conductive foil is controlled by using the second conductive foil, and thereby the gain of the antenna can achieve unidirectionality. Since the grounded conductive foil, the first conductive foil, and the second conductive foil are all disposed on one substrate, the antenna can be configured in a planar area of the substrate, the planar area having a thickness not substantially exceeding the thickness of the substrate. In addition, the antenna together with various circuits such as a communication circuit is easily mounted on the substrate. In particular, the first conductive foil and the second conductive foil each have the one end that is supplied with power and that is grounded and the other end that is open and thus operate as a monopole antenna. Accordingly, the first conductive foil and the second conductive foil can be configured in an area for a ¼ wave length. This provides a unidirectional antenna enabled to be configured on one substrate thinly and in a small size. The grounded conductive foil may also serve as a grounded conductive foil for power supply. In this case, the area occupied by the antenna is reduced, and the reduction further contributes to downsizing of a set.

The first conductive foil and the second conductive foil may be disposed substantially parallel to each other and may be disposed side by side in a direction orthogonal to a lengthwise direction.

With this configuration, a Yagi-Uda antenna with the first conductive foil and the second conductive foil respectively serving as a radiating element and a reflector is configured, and thus an antenna having a sharp directivity pattern is provided.

The second conductive foil may include two second conductive foils, and the second conductive foils may be respectively disposed at opposite sides of the first conductive foil.

With this configuration, one of the second conductive foils and the other respectively function as a reflector and a director, and the unidirectional antenna is thereby provided.

The one end of the first conductive foil and the one end of the second conductive foil may be located along the edge of the grounded conductive foil in the plan view of the substrate.

With this configuration, the grounded conductive foil causes the formation of the mirror images of the first conductive foil and the second conductive foil, and the gain of the antenna is thereby enhanced.

The antenna may further include a wiring conductor that transmits an antenna signal, and the one end of the first conductive foil may be connected to the wiring conductor.

With this configuration, the antenna signal can be fed to the first conductive foil via the wiring conductor from a required location on the substrate, such as from the communication circuit mounted together with the antenna.

The antenna may further include an impedance element, and the one end of the second conductive foil may be connected to the grounded conductive foil by using the impedance element.

With this configuration, the directivity corresponding to the antenna gain can be controlled on the basis of the impedance value of the impedance element after the patterns of the first conductive foil and the second conductive foil are determined.

A wireless module according to an aspect of the present disclosure includes a communication circuit provided to the substrate on which the above-described antenna is formed.

With this configuration, the communication circuit and the above-described antenna are disposed on one substrate, and thereby a small and highly convenient wireless module is provided.

With the antenna and the wireless module according to the present disclosure, a unidirectional antenna and a wireless module enabled to be configured on one substrate and in a small size are provided.

Figures 2A, 2B:
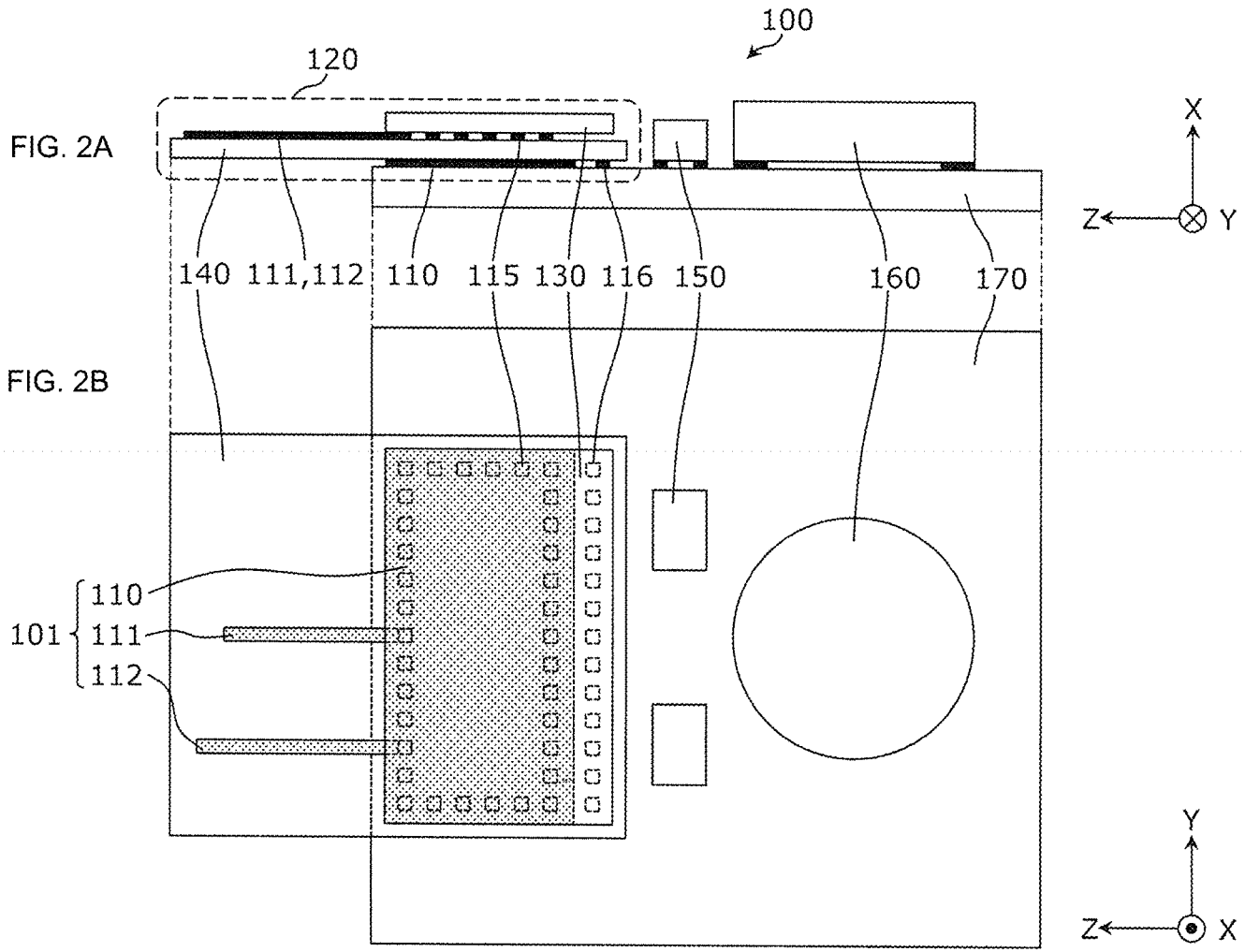

Each of FIGS. 2A and 2B illustrates an example configuration of the communication device according to Embodiment 1, including FIG. 2A that is a side view and FIG. 2B that is a top view.

Figures 3A, 3B:
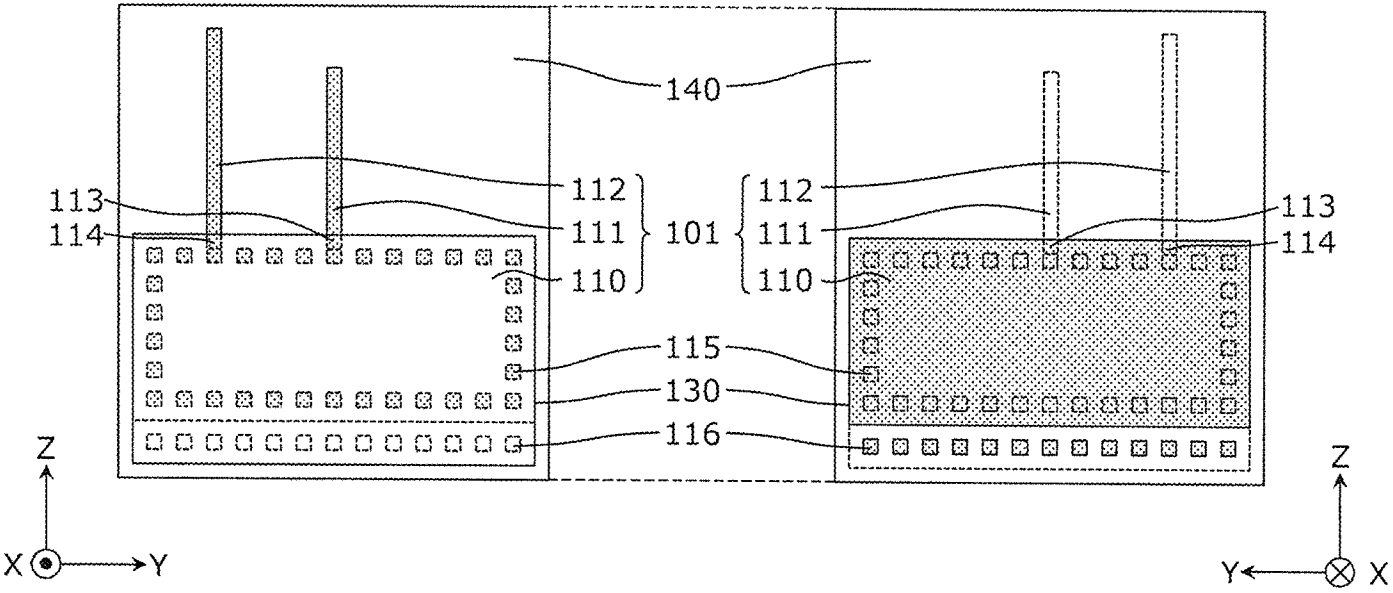

Each of FIGS. 3A and 3B illustrates an example configuration of the antenna according to Embodiment 1, including FIG. 3A that is a top view and FIG. 3B that is a bottom view.

Figures 4A, 4B:
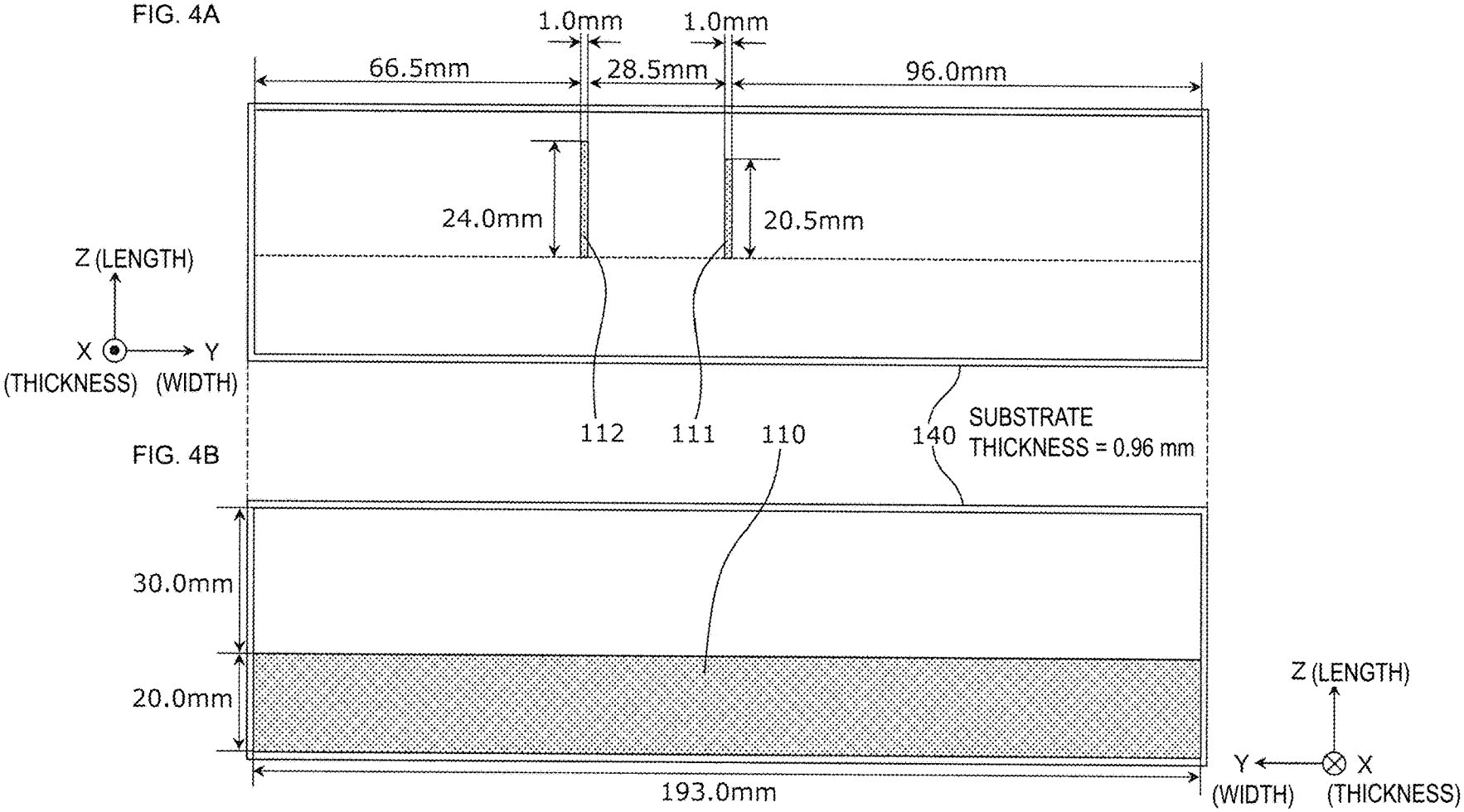

Each of FIGS. 4A and 4B illustrates an example of the dimensions of the antenna according to Embodiment 1, including FIG. 4A that is a top view and FIG. 4B that is a bottom view.

Figure 5:
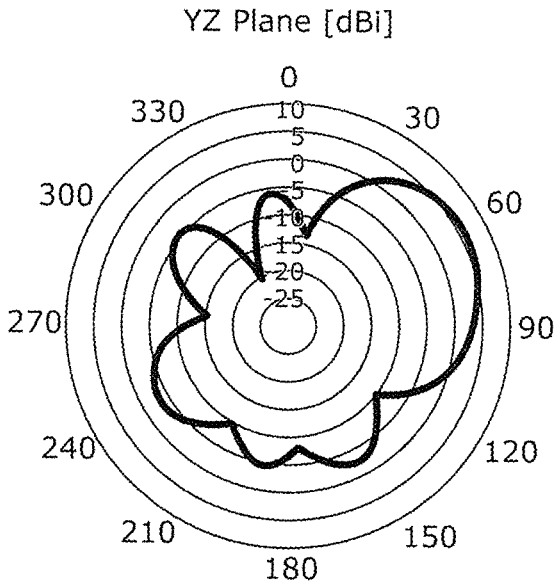

FIG. 5 is a radar chart illustrating an example of the directivity corresponding to the gain of the antenna according to Embodiment 1.

Figures 6A, 6B:
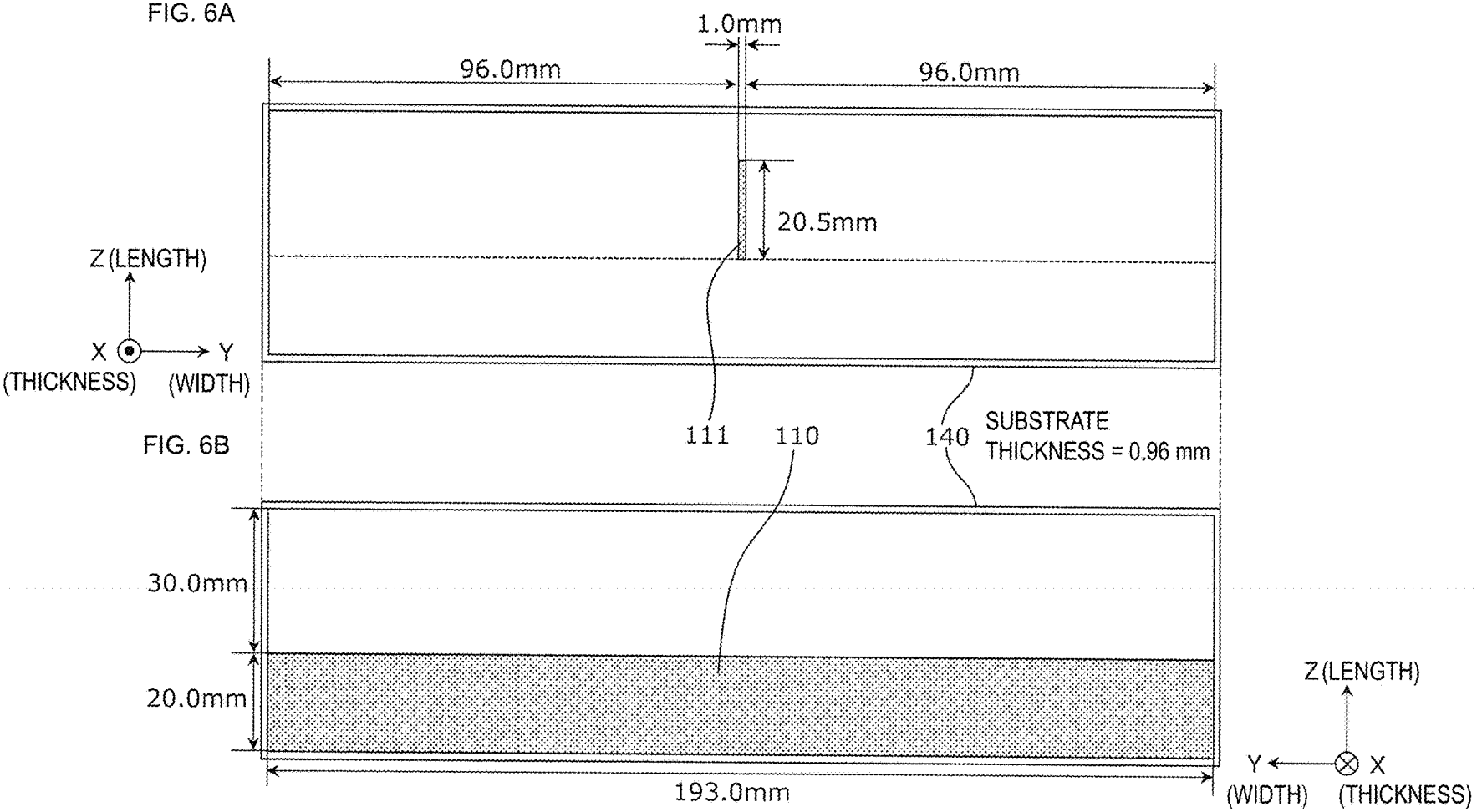

Each of FIGS. 6A and 6B illustrates an example configuration of an antenna according to Comparative Example, including FIG. 6A that is a top view and FIG. 6B that is a bottom view.

Figure 7:
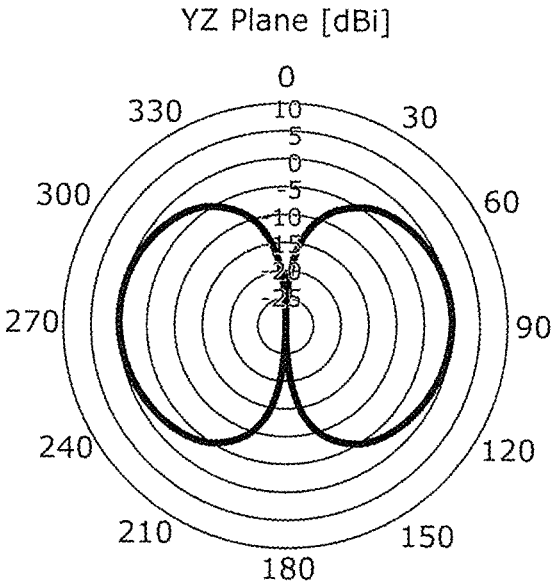

FIG. 7 is a radar chart illustrating an example of the directivity corresponding to the gain of the antenna according to Comparative Example.

Figure 8:
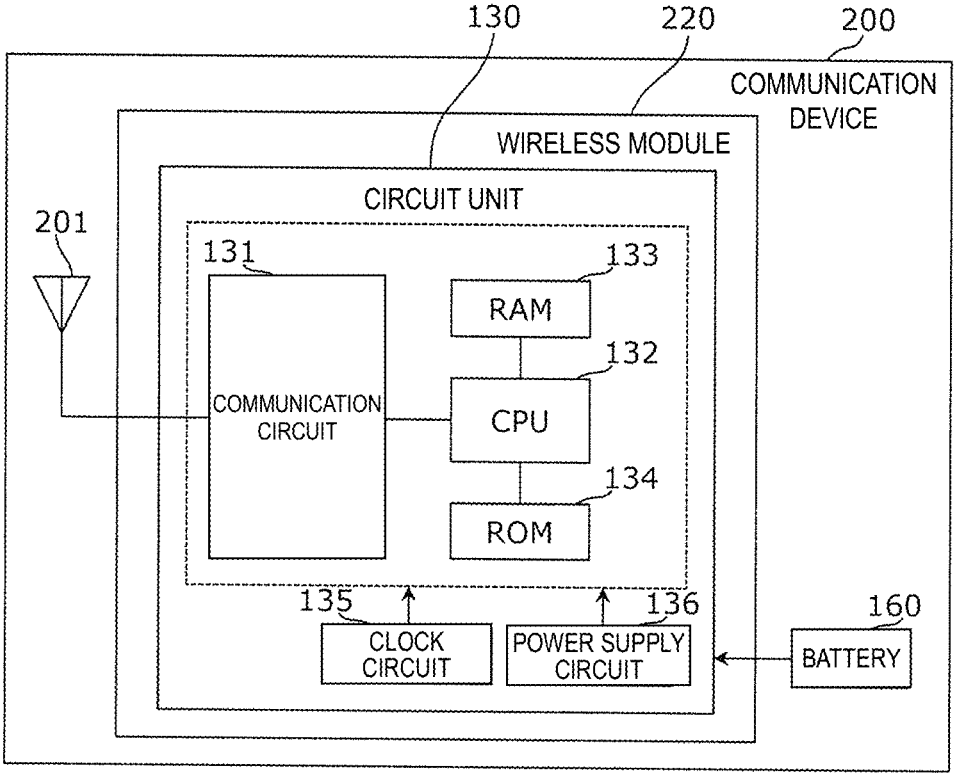

FIG. 8 is a block diagram illustrating an example functional configuration of a communication device including an antenna according to Embodiment 2.

Figures 9A, 9B:
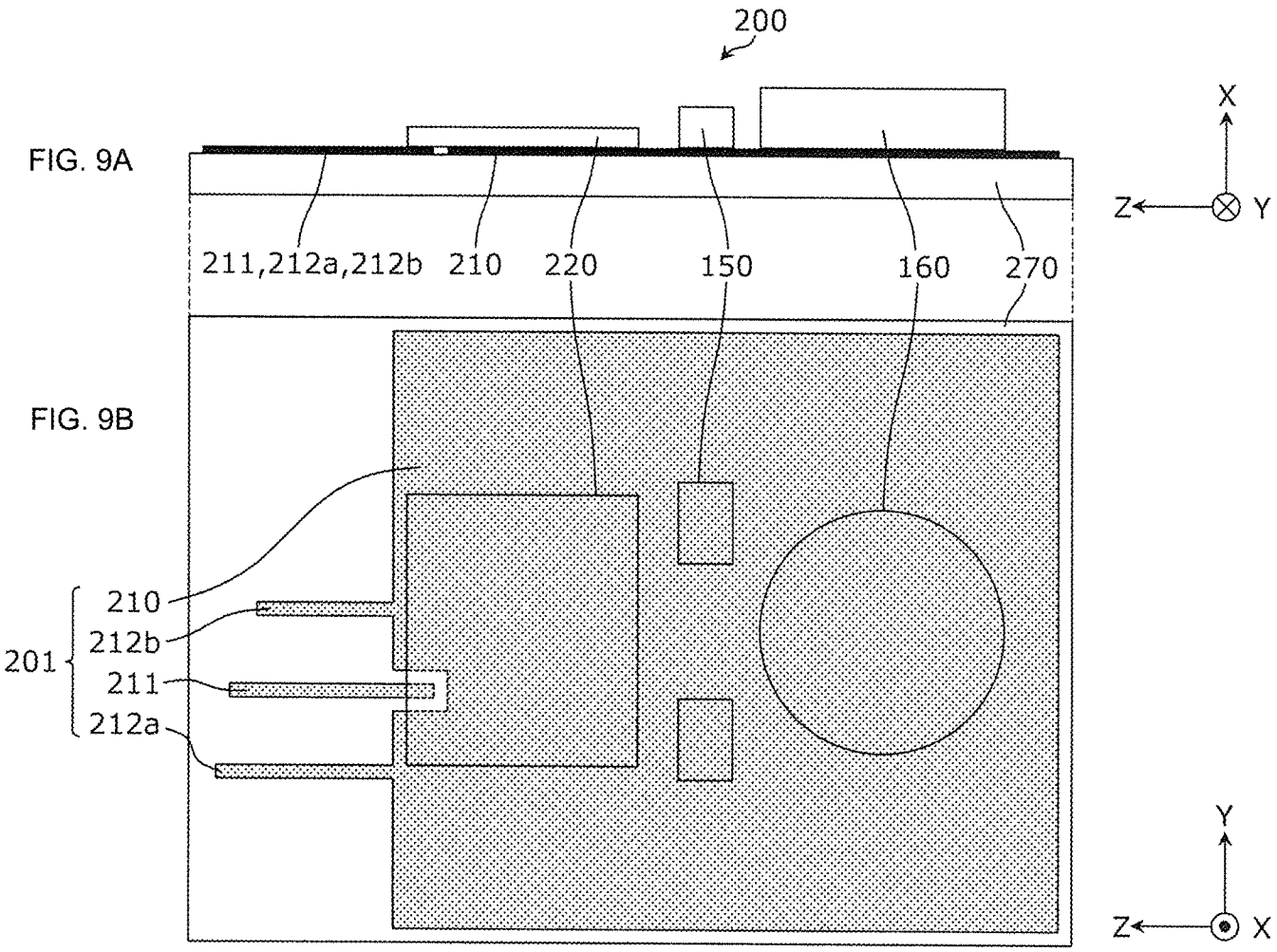
Figures 10A, 10B:
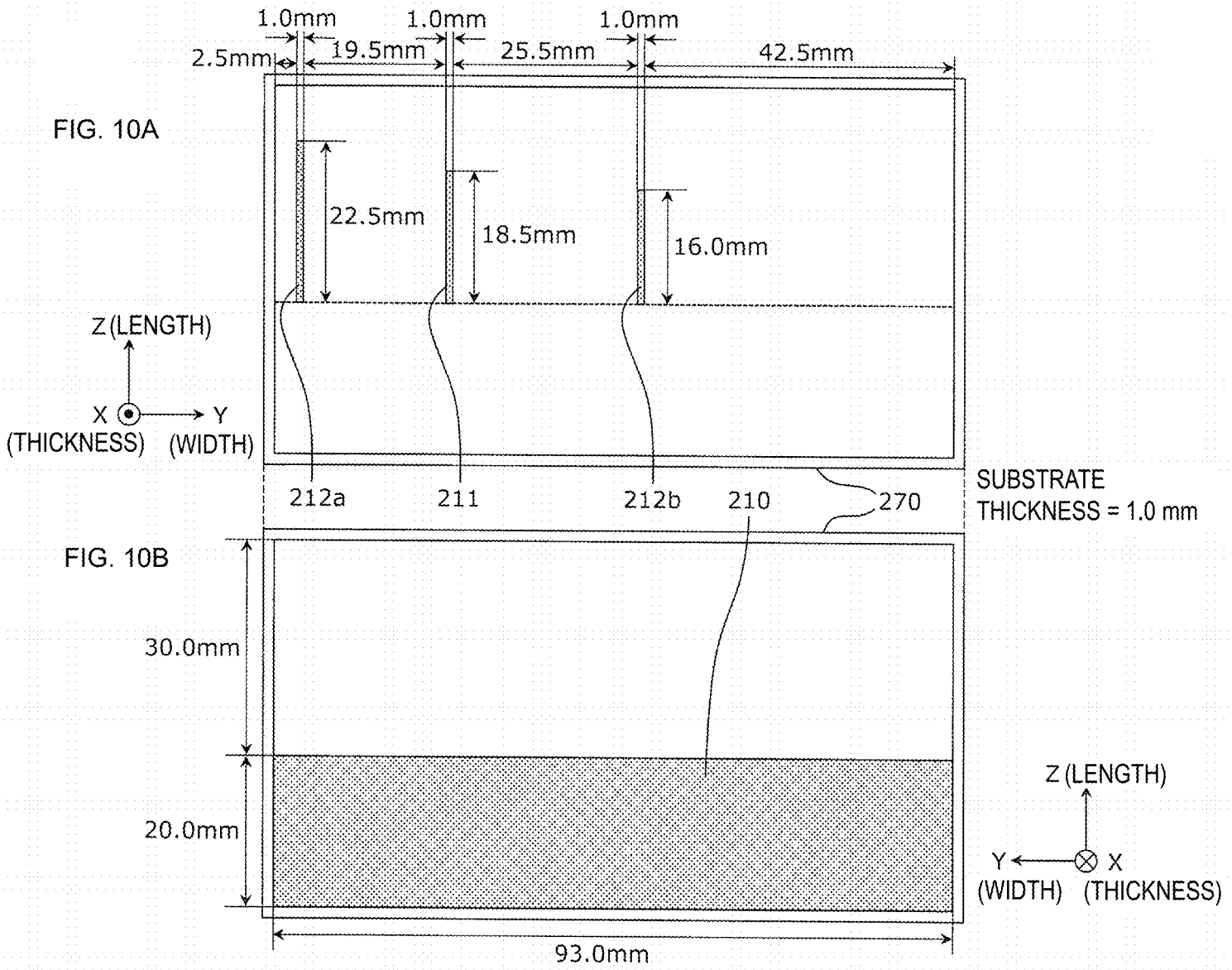

Each of FIGS. 9A and 9B illustrates an example configuration of the communication device and the antenna according to Embodiment 2, including FIG. 9A that is a side view and FIG. 9B that is a top view.

each of FIGS. 10A and 10B illustrates an example of the dimensions of the antenna according to Embodiment 2, including FIG. 10A that is a top view and FIG. 10B that is a bottom view.

Figure 11:
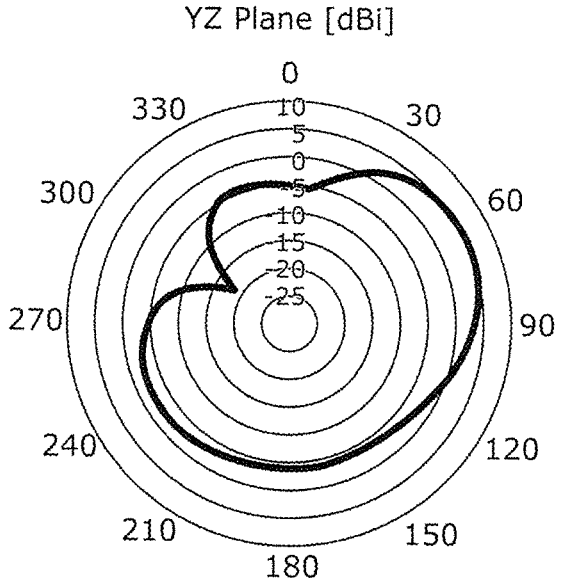

FIG. 11 is a radar chart illustrating an example of the directivity corresponding to the gain of the antenna according to Embodiment 2.

DETAILED DESCRIPTION OF THE DISCLOSURE

Hereinafter, embodiments of the present disclosure will be described in detail by using the drawings. Note that each embodiment to be described later represents a comprehensive or specific example. A numeric value, a shape, a material, a component, the arrangement and connection form of the component, and the like described in the following embodiments are an example and are not intended to limit the present disclosure. Among components in the following embodiments, a component that is not described in an independent claim is described as an optional component. The sizes and the ratio of the sizes of components in the drawings are not necessarily precisely illustrated.

Embodiment 1

An antenna according to Embodiment 1 is a unidirectional antenna including conductive foils in predetermined patterns on a substrate. The substrate is provided with various circuits including a communication circuit, together with the antenna, and a wireless module is configured by using the components. The wireless module is used in a communication device such as a radio beacon.

Note that the radio beacon is a near-field device that wirelessly provides information. The radio beacon has been increasingly widely used in recent years and provides, for example, information regarding an installation location and information regarding a product placed in the installation location to a communication instrument nearby by using radio signals. The characteristics of the radio beacon might lead to a desire to limit the radiation of the radio signals to a specific direction (that is, a desire to have the antenna gain corresponding to unidirectionality). The antenna according to Embodiment 1 is usable for such a purpose, for example.

Figure 1:
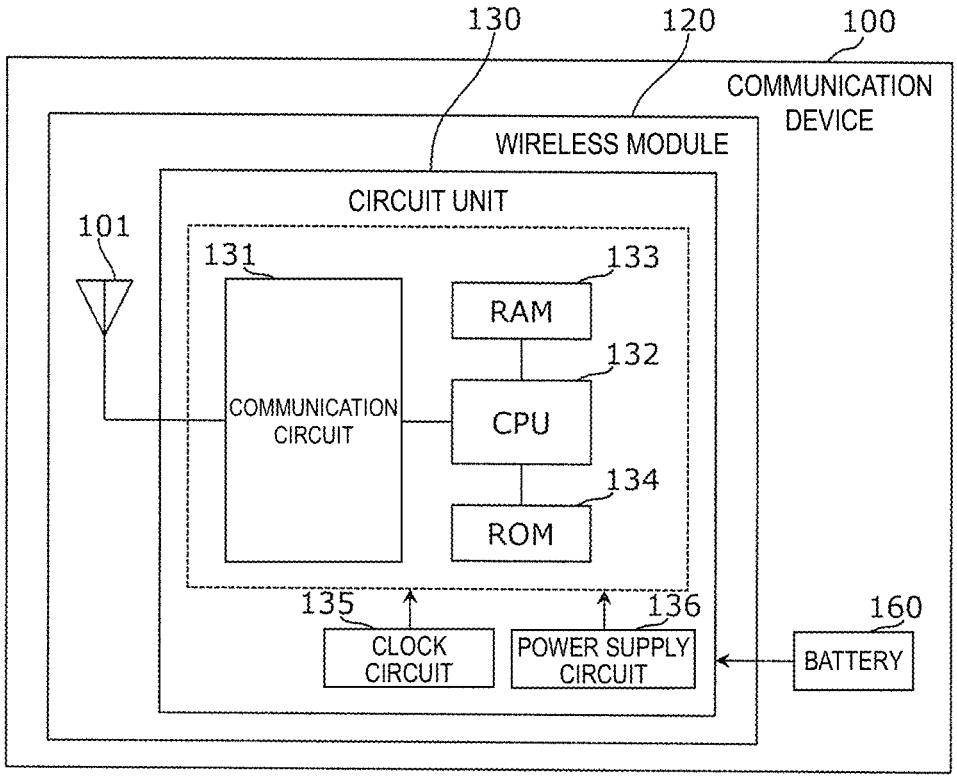
FIG. 1 is a block diagram illustrating an example functional configuration of a communication device including an antenna according to Embodiment 1.

FIG. 1 is a block diagram illustrating an example functional configuration of a communication device including the antenna according to Embodiment 1. As illustrated in FIG. 1, a communication device 100 includes a wireless module 120 and a battery 160, the wireless module 120 including an antenna 101 and a circuit unit 130.

The circuit unit 130 has a communication circuit 131, a central processing unit (CPU) 132, a random access memory (RAM) 133, a read only memory (ROM) 134, a clock circuit 135, and a power supply circuit 136.

The content (for example, product information) of signals to be transmitted by using the communication circuit 131 and a communication circuit control program have been written in the ROM 134 connected to the CPU 132. The RAM 133 is a memory area for running the communication circuit control program.

The communication circuit 131 is an electronic circuit that transmits, to a receiver (not illustrated) such as a smartphone, information regarding wireless connection control, a product, and the like by using a communication system such as Bluetooth (registered trademark) LowEnergy (BLE). The communication circuit 131 transmits and receives radio signals (electromagnetic waves with radio frequencies) by using the antenna 101.

The clock circuit 135 and the power supply circuit 136 generate clock signals and a power supply voltage necessary for the operations of the circuit unit 130 and supply the clock signals and the power supply voltage to the communication circuit 131, the CPU 132, the RAM 133, and the ROM 134.

Each of FIGS. 2A and 2B is a view illustrating an example configuration of the communication device 100, and FIG. 2A and FIG. 2B are respectively a side view and a top view. For easy understanding, each of FIGS. 2A and 2B illustrates conductive foils in gray that are included in the antenna 101.

As illustrated in FIGS. 2A and 2B, the communication device 100 includes the wireless module 120 and the battery 160 that are mounted on a set substrate 170, the wireless module 120 having the antenna 101 and the circuit unit 130 integrated therein. Components 150 such as a power supply module, a switch, and a memory for setting various communication conditions may be mounted on the set substrate 170. The set substrate 170 may be composed of, for example, a printed circuit board.

The wireless module 120 includes a grounded conductive foil 110, a first conductive foil 111, a second conductive foil 112, first terminals 115, second terminals 116, and the circuit unit 130 that are provided to a module substrate 140.

The antenna 101 includes the grounded conductive foil 110, the first conductive foil 111, and the second conductive foil 112 respectively serving as a ground plane, a feed element, and a parasitic element. The grounded conductive foil 110 may also serve as a grounded conductive foil for power supply.

The module substrate 140 may be composed of, for example, a printed circuit board or a ceramic multi-layer substrate.

The circuit unit 130 includes various components such as an integrated circuit (IC) chip and a discrete component mounted on the first terminals 115 by using a conductive binder such as solder. The circuit unit 130 may be covered by a shield case. The wireless module 120 is mounted on the set substrate 170 by using a conductive binder such as solder with the second terminals 116 interposed therebetween.

The detailed description about the antenna 101 is continued.

Each of FIGS. 3A and 3B is a view illustrating an example configuration of the antenna 101, and FIG. 3A and FIG. 3B are respectively a top view and a bottom view. In the following description, the term "upper" is conveniently used for an upper location in a direction in which an X coordinate value increases, and the term "lower" is used for a lower location in a direction in which the X coordinate value decreases. For easy understanding, conductive foils disposed on the upper surface and the lower surface of the module substrate 140 are illustrated in gray in FIGS. 3A and 3B.

As illustrated in FIGS. 3A and 3B, the first conductive foil 111, the second conductive foil 112, conductive foils 113 and 114 for connection, and the first terminals 115 are disposed on the upper surface of the module substrate 140, and the grounded conductive foil 110 and the second terminals 116 are disposed on the lower surface of the module substrate 140. The first conductive foil 111 and the second conductive foil 112 are elongated and do not overlap with the grounded conductive foil 110 in a plan view of the module substrate 140 (that is, when the module substrate 140 is viewed in an X-axis direction).

The first conductive foil 111 has one end close to the grounded conductive foil 110 and connected to the conductive foil 113. Antenna signals are supplied from the circuit unit 130 via the conductive foil 113. The other end located farther from the grounded conductive foil 110 is open. Note that the phrase "the other end is open" denotes that the other end is not connected to any other conductive members. The phrase is hereinafter used in the same meaning.

The second conductive foil 112 has one end close to the grounded conductive foil 110. The one end is connected to the grounded conductive foil 110 with a via (not illustrated) interposed therebetween, the via piercing the conductive foil 114 and the module substrate 140. The other end located farther from the grounded conductive foil 110 is open.

With the configuration as described above, the directivity corresponding to the antenna gain caused by the first conductive foil 111 is controlled by using the second conductive foil 112, and thereby the gain of the antenna 101 can achieve unidirectionality. Since the grounded conductive foil 110, the first conductive foil 111, and the second conductive foil 112 are all disposed on the one module substrate 140, the antenna 101 can be configured in a planar area having a thickness not substantially exceeding the thickness of the module substrate 140 and can be easily mounted, together with the circuit unit 130, on the module substrate 140.

In particular, the one end of each of the first conductive foil 111 and the second conductive foil 112 is supplied with power and is grounded, and the other end is open. The first conductive foil 111 and the second conductive foil 112 thereby operate as a monopole antenna and thus can be configured in an area for a ¼ wave length. This leads to a unidirectional antenna configured on the one module substrate 140 thinly and in a small size.

The grounded conductive foil 110 may also serve as the grounded conductive foil for power supply. In this case, the area occupied by the antenna 101 is reduced, and further the contribution to downsizing of a set can be achieved.

The first conductive foil 111 and the second conductive foil 112 are disposed substantially parallel to each other and disposed side by side in a direction orthogonal to a lengthwise direction (in a Y-axis direction in the example in FIGS. 3A and 3B). This causes a Yagi-Uda antenna to be configured, the Yagi-Uda antenna having a sharp unidirectional pattern and having the first conductive foil 111 and the second conductive foil 112 respectively serving as a radiating element and a reflector.

The one end of the first conductive foil 111 and the one end of the second conductive foil 112 are located along the edge of the grounded conductive foil 110 in the plan view of the module substrate 140. The grounded conductive foil 110 thus causes the formation of the mirror images of the first conductive foil 111 and the second conductive foil 112, and the gain of the antenna 101 is thereby enhanced.

It is not essential to connect the one end of the second conductive foil 112 to the grounded conductive foil 110 with the conductive foil 114 and the via interposed therebetween. For example, the module substrate 140 may be provided with an impedance element (not illustrated) such as a chip coil, and the one end of the second conductive foil 112 and the grounded conductive foil 110 may be connected to each other by using the impedance element. This enables the directivity corresponding to the antenna gain to be controlled on the basis of the impedance value of the impedance element after the patterns of the first conductive foil 111 and the second conductive foil 112 are determined. The second conductive foil 112 can also be made shorter. Further, the use of a variable impedance element based on MEMS as the impedance element enables the directivity corresponding to the antenna gain to be variable.

In addition, it is not essential to dispose the first conductive foil 111 and the second conductive foil 112 on the same surface of the module substrate 140 (on the upper surface in the above-described example). For example, the first conductive foil 111 and the second conductive foil 112 may be respectively disposed on the upper surface and the lower surface of the module substrate 140. In a case where the module substrate 140 is a multi-layer substrate, at least one of the grounded conductive foil 110, the first conductive foil 111, and the second conductive foil 112 may be provided to a wiring layer that is an unexposed inner layer.

To verify the directivity of the antenna 101 configured as described above, the inventors have configured the antennas according to the embodiment and Comparative Example, performed the simulation, and thereby obtained the directivity corresponding to the gain of each antenna.

Each of FIGS. 4A and 4B is a view illustrating an example of the dimensions of the antenna according to the embodiment, and FIG. 4A and FIG. 4B are respectively a top view and a bottom view. In the following description, the dimensions in the directions along an X axis, a Y axis, and a Z axis are conveniently referred to as a thickness, a width, and a length, respectively.

As illustrated in FIGS. 4A and 4B, the module substrate 140 having a length of 50.0 mm, a width of 193.0 mm, and a thickness of 0.96 mm is assumed. The lower surface of the module substrate 140 is divided into a first portion having a length of 20.0 mm and a second portion having a length of 30.0 mm, and the grounded conductive foil 110 is disposed in the first portion.

The first conductive foil 111 having a length of 20.5 mm and a width of 1.0 mm and the second conductive foil 112 having a length of 24.0 mm and a width of 1.0 mm are disposed in a portion on the upper surface which is opposite to the second portion (that is, the portion that does not overlap with the grounded conductive foil 110 in the plan view). The one end of the first conductive foil 111 is aligned on the edge of the grounded conductive foil 110 and disposed at the middle of the width of the module substrate 140. The one end of the second conductive foil 112 is aligned on the edge of the grounded conductive foil 110, and the second conductive foil 112 is disposed 28.5 mm away from the first conductive foil 111.

The first conductive foil 111 is not connected to the grounded conductive foil 110 and is supplied with antenna signals via the one end of the first conductive foil 111. For the second conductive foil 112, the one end is connected to the grounded conductive foil 110.

FIG. 5 is a radar chart illustrating an example of the directivity of the gain of the antenna according to the embodiment. The example in FIG. 5 illustrates an example of the directivity on the YZ plane of the antenna gain of horizontally polarized radio signals with a frequency of 2442 MHz (that is, in a 2.4 GHz band having a center frequency from 2400 to 2483.5 MHz). The directivity is the result of the simulation using the antenna with the dimensions in FIGS. 4A and 4B.

As illustrated in FIG. 5, appropriately setting the location, the width, and the length of the second conductive foil 112 that is the parasitic element causes the second conductive foil 112 to operate as a reflector and thus to constitute an antenna array. The antenna gain can thus achieve the unidirectionality. Note that the directivity exhibits the inclination because the area of the grounded conductive foil 110 is limited and thus the current flowing through the grounded conductive foil 110 contributes to the radiation.

Each of FIGS. 6A and 6B is a view illustrating an example of the dimensions of the antenna according to Comparative Example, and FIG. 6A and FIG. 6B are respectively a top view and a bottom view. The antenna is different from the antenna according to the embodiment in FIGS. 4A and 4B in that the second conductive foil 112 is omitted.

FIG. 7 is a radar chart illustrating an example of the directivity of the gain of the antenna according to Comparative Example. The example in FIG. 7 illustrates an example of a directivity pattern on the YZ plane of the antenna gain of horizontally polarized radio signals with a frequency of 2442 MHz. The directivity pattern is the result of the simulation using the antenna with the dimensions in FIGS. 6A and 6B. In the simulation, a figure-of-eight directivity pattern that is symmetrical and that is specific to a monopole antenna is observed, as illustrated in FIG. 7.

From these simulation results, it is verified that simply forming the second conductive foil 112 on the substrate having the first conductive foil 111 functioning as the monopole antenna causes the antenna gain to achieve the unidirectionality without employing an additional radiating element or a solid structure.

Since the second conductive foil 112 can be formed when the patterning of the conductive foils are performed on the printed circuit board, additional cost for providing the second conductive foil 112 is not incurred. According to the antenna of the embodiment, a planar antenna with antenna gain achieving unidirectionality is provided by using substantially the same size and cost as those for the planar monopole antenna in Comparative Example.

This enables a unidirectional planar antenna to be employed for a communication device such as a radio beacon having a planar monopole antenna, without an increase in size and cost.

Embodiment 2

An antenna according to Embodiment 2 is a unidirectional antenna including conductive foils on a substrate in predetermined patterns, like the antenna according to Embodiment 1. The antenna according to Embodiment 2 is different from the antenna according to Embodiment 1 in that the antenna according to Embodiment 2 is formed on the set substrate, instead of the module substrate and is also different in the details of the shapes of conductive foils included in the antenna. Hereinafter, the components described in Embodiment 1 are denoted by the same reference numerals, and description thereof is omitted. Matters different from those in Embodiment 1 will mainly be described.

FIG. 8 is a block diagram illustrating an example functional configuration of a communication device including the antenna according to Embodiment 2. As illustrated in FIG. 8, a communication device 200 includes an antenna 201, a wireless module 220 including the circuit unit 130, and the battery 160. The wireless module 220 includes the circuit unit 130 and does not include the antenna 201. The circuit unit 130 has the same functional configuration as that of the circuit unit 130 in Embodiment 1.

Each of FIGS. 9A and 9B is a view illustrating an example configuration of the communication device 200 and the antenna 201, and FIG. 9A and FIG. 9B are respectively a side view and a top view. In the following description, the term "upper" is conveniently used for an upper location in the direction in which the X coordinate value increases, and the term "lower" is used for a lower location in the direction in which the X coordinate value decreases. For easy understanding, conductive foils included in the antenna 201 are illustrated in gray in FIG. 9B.

As illustrated in FIGS. 9A and 9B, the communication device 200 includes a grounded conductive foil 210, a first conductive foil 211, and second conductive foils 212*a* and 212*b* that are disposed on the upper surface of a set substrate 270, the wireless module 220, and the battery 160. The components 150 such as a power supply module, a switch, and a memory for setting various communication conditions may be mounted on the upper surface of the set substrate 270. The set substrate 270 may be composed of, for example, a printed circuit board.

The antenna 201 includes the grounded conductive foil 210, the first conductive foil 211, and the second conductive foils 212*a* and 212*b* respectively serving as a ground plane, a feed element, and parasitic elements. The grounded conductive foil 210 may also serve as a grounded conductive foil for power supply.

The wireless module 220 may be a module component in which the antenna 101 is omitted in the wireless module 120 in FIGS. 2A and 2B or may also be a so-called system-on-chip including all of the circuit blocks of the circuit unit 130 that are integrated into a chip. In FIGS. 9A and 9B, the illustration of the terminals for mounting the wireless module 220, the components 150, and the battery 160 on the set substrate 270 is omitted.

The detailed description about the antenna 201 is continued.

The first conductive foil 211 and the second conductive foils 212*a* and 212*b* are elongated and do not overlap with the grounded conductive foil 210 in a plan view of the set substrate 270 (that is, when the set substrate 270 is viewed in the X-axis direction).

The first conductive foil 211 is supplied antenna signals from the wireless module 220 via one end close to the grounded conductive foil 210. The other end located farther from the grounded conductive foil 210 is open.

Each of the second conductive foils 212*a* and 212*b* has one end close to the grounded conductive foil 210 connected to the grounded conductive foil 210, and the other end located farther from the grounded conductive foil 210 is open. The second conductive foils 212*a* and 212*b* may each be the same conductive foil as the grounded conductive foil 210 and formed to be continuous with the grounded conductive foil 210.

With the configuration as described above, the directivity corresponding to the antenna gain caused by the first conductive foil 211 is controlled by using the second conductive foils 212*a* and 212*b*, and thereby the gain of the antenna 201 can achieve unidirectionality. Since the grounded conductive foil 210, the first conductive foil 211, and the second conductive foils 212*a* and 212*b* are all disposed on the one set substrate 270, the antenna 201 can be configured in a planar area having a thickness not substantially exceeding the thickness of the set substrate 270 and can be easily mounted, together with the wireless module 220 including the circuit unit 130, on the set substrate 270.

In particular, the one end of each of the first conductive foil 211 and the second conductive foils 212*a* and 212*b* is supplied with power and is grounded, and the other end is open. The first conductive foil 211 and the second conductive foils 212*a* and 212*b* thereby operate as a monopole antenna and thus can be configured in an area for the ¼ wave length. This leads to a unidirectional antenna configured on the one set substrate 270 thinly and in a small size.

The grounded conductive foil 210 may also serve as the grounded conductive foil for power supply. In this case, the area occupied by the antenna 201 is reduced, and further the contribution to downsizing of the set can be achieved.

The first conductive foil 211 and the second conductive foils 212*a* and 212*b* are disposed substantially parallel to each other and disposed side by side in the direction orthogonal to the lengthwise direction (in the Y-axis direction in the example in FIGS. 9A and 9B). This causes a Yagi-Uda antenna to be configured, the Yagi-Uda antenna having a sharp unidirectional pattern and having the first conductive foil 211 serving as a radiating element and the second conductive foils 212*a* and 212*b* respectively serving as a reflector and a director.

The one end of the first conductive foil 211 and the one ends of the respective second conductive foils 212*a* and 212*b* are located along the edge of the grounded conductive foil 210 in the plan view of the set substrate 270. The grounded conductive foil 210 thus causes the formation of the mirror images of the first conductive foil 211 and the second conductive foils 212*a* and 212*b*, and the gain of the antenna 201 is thereby enhanced.

It is not essential that the one ends of the respective second conductive foils 212*a* and 212*b* are continuous with the grounded conductive foil 210. For example, the set substrate 270 may be provided with an impedance element (not illustrated) such as a chip coil, and the one ends of the respective second conductive foils 212*a* and 212*b* may be connected to the grounded conductive foil 210 by using the impedance element. This enables the directivity corresponding to the antenna gain to be controlled on the basis of the impedance value of the impedance element after the patterns of the first conductive foil 211 and the second conductive foils 212*a* and 212*b* are determined. The second conductive foils 212*a* and 212*b* can also be made shorter. Further, the use of a variable impedance element based on MEMS as the impedance element enables the directivity corresponding to the antenna gain to be variable.

In addition, it is not essential to dispose the first conductive foil 211 and the second conductive foils 212*a* and 212*b* on the same surface of the set substrate 270 (the upper surface in the above-described example). For example, the first conductive foil 211 may be disposed on the upper surface of the set substrate 270, and the grounded conductive foil 210 and the second conductive foils 212*a* and 212*b* may be disposed on the lower surface of the set substrate 270. In a case where the set substrate 270 is a multi-layer substrate, at least one of the grounded conductive foil 210, the first conductive foil 211, and the second conductive foils 212*a* and 212*b* may be provided to a wiring layer that is an unexposed inner layer.

To verify the directivity of the antenna 201 configured as described above, the inventors have configured an antenna according to the embodiment, performed simulation, and thereby obtained the directivity corresponding to the antenna gain. In the simulation, to make a comparison with the embodiment in Embodiment 1, an antenna in which the first conductive foil 211 and the second conductive foils 212*a* and 212*b* are disposed on the upper surface of the set substrate 270, and the grounded conductive foil 210 is disposed on the lower surface of the set substrate 270 is configured.

Each of FIGS. 10A and 10B is a view illustrating an example of the dimensions of the antenna according to the embodiment, and FIG. 10A and FIG. 10B are respectively a top view and a bottom view. In the following description, the dimensions in the directions along the X axis, the Y axis, and the Z axis are conveniently referred to as a thickness, a width, and a length, respectively.

As illustrated in FIGS. 10A and 10B, the set substrate 270 having a length of 50.0 mm, a width of 93.0 mm, and a thickness of 1.0 mm is assumed. The lower surface of the set substrate 270 is divided into a first portion having a length of 20.0 mm and a second portion having a length of 30.0 mm, and the grounded conductive foil 210 is disposed in the first portion.

The first conductive foil 211 having a length of 18.5 mm and a width of 1.0 mm, the second conductive foil 212*a* having a length of 22.5 mm and a width of 1.0 mm, and the second conductive foil 212*b* having a length of 16.0 mm and a width of 1.0 mm are disposed in the portion on the upper surface and opposite the second portion (that is, the portion that does not overlap with the grounded conductive foil 210 in the plan view).

The one end of the second conductive foil 212*a* is aligned on the edge of the grounded conductive foil 210, and the second conductive foil 212*a* is disposed 2.5 mm away widthwise from the left side of the grounded conductive foil 210. The one end of the first conductive foil 211 is aligned on the edge of the grounded conductive foil 210, and the first conductive foil 211 is disposed 19.5 mm away from the second conductive foil 212*a*. The one end of the second conductive foil 212*b* is aligned on the edge of the grounded conductive foil 210, and the second conductive foil 212*b* is disposed on the opposite side of the first conductive foil 211 from the second conductive foil 212*a* and 25.5 mm away from the first conductive foil 211. The second conductive foil 212*b* is 42.5 mm away widthwise from the right side of the grounded conductive foil 210.

The first conductive foil 211 is not connected to the grounded conductive foil 210 and is supplied with antenna signals via the one end of the first conductive foil 211. The one end of the second conductive foil 212*a* and the one end of the second conductive foil 212*b* are connected to the grounded conductive foil 210.

FIG. 11 is a radar chart illustrating an example of the directivity pattern of the antenna according to the embodiment. The example in FIG. 11 illustrates an example of a directivity pattern on the YZ plane of the antenna gain of horizontally polarized radio signals with a frequency of 2442 MHz. The directivity pattern is the result of the simulation using the antenna with the predetermined dimensions.

As illustrated in FIG. 11, appropriately setting the location, the width, and the length of the second conductive foils 212*a* and 212*b* that are parasitic elements causes the second conductive foils 212*a* and 212*b* to respectively operate as a reflector and a director and thus to constitute an antenna array. The antenna gain can thus achieve unidirectionality. Note that the directivity exhibits the inclination because the area of the grounded conductive foil 210 is limited and thus the current flowing through the grounded conductive foil 210 contributes to the radiation.

From these simulation results, it is verified that simply forming the second conductive foils 212*a* and 212*b* on the substrate having the first conductive foil 211 functioning as the monopole antenna causes the antenna gain to achieve the unidirectionality without employing an additional radiating element or a solid structure.

Since the second conductive foils 212*a* and 212*b* can be formed when the patterning of the conductive foils are performed on the printed circuit board, additional cost for providing the second conductive foils 212*a* and 212*b* is not incurred. According to the antenna of the embodiment, a planar antenna with antenna gain achieving unidirectionality is provided by using substantially the same size and cost as those for the planar monopole antenna in Comparative Example.

This enables a unidirectional planar antenna to be employed for a communication device such as a radio beacon having a planar monopole antenna, without an increase in size and cost.

Note that the two parasitic elements (the second conductive foils) have been illustrated in the above-described example; however, increasing the number of parasitic elements can lead to the optimization of the directivity corresponding to the antenna gain.

The antenna and the wireless module according to the embodiments of the present disclosure have heretofore been described; however, the present disclosure is not limited to the individual embodiments. Without departing from the spirit of the present disclosure, forms in which various modifications conceived of by those skilled in the art are made to the embodiments and which are built up by combining components in different embodiments may also be included in one or more aspects of the present disclosure.

The present disclosure is widely used for a wireless apparatus using a unidirectional antenna, such as a radio beacon.

100, 200 communication device
101, 201 antenna
110, 210 grounded conductive foil
111, 211 first conductive foil
112, 212*a*, 212*b* second conductive foil
113, 114 conductive foil for connection
115 first terminal
116 second terminal
120, 220 wireless module
130 circuit unit
131 communication circuit
132 CPU
133 RAM
134 ROM
135 clock circuit
136 power supply circuit
140 module substrate
150 component
160 battery
170, 270 set substrate

What is claimed is:

1. An antenna comprising:
a substrate including a first surface and a second surface opposed to the first surface;
a grounded conductive foil disposed on the substrate;
a first conductive foil; and
a second conductive foil,
wherein the first conductive foil and the second conductive foil are disposed on the substrate, are elongated, and are not overlapping with the grounded conductive foil in a plan view of the substrate,
wherein the first conductive foil has one end supplied with an antenna signal and another end being open;
wherein the second conductive foil has one end connected to the grounded conductive foil and another end being open; and
wherein the first conductive foil and the second conductive foil are arranged on the first surface, and
wherein the grounded conductive foil is arranged on the second surface and is connected to the second conductive foil through a via without overlapping the first and second conductive foils in the plan view of the substrate.

2. The antenna according to claim 1, wherein the first conductive foil and the second conductive foil are disposed substantially parallel to each other and disposed side by side in a direction orthogonal to the elongated direction of each of the first conductive foil and the second conductive foil.

3. The antenna according to claim 2,
wherein the second conductive foil includes two second conductive foils being parallel to each other, and
wherein the two second conductive foils are respectively disposed at opposite sides of the first conductive foil.

4. The antenna according to claim 3, wherein the one end of the first conductive foil and the one end of each of the two second conductive foils are located along an edge of the grounded conductive foil in the plan view of the substrate.

5. The antenna according to claim 3, further comprising:
an impedance element,
wherein the one end of each of the two second conductive foils is connected to the grounded conductive foil via the impedance element.

6. A wireless module comprising a communication circuit provided on the substrate of the antenna according to claim 3.

7. The antenna according to claim 2, wherein the one end of the first conductive foil and the one end of each of the two second conductive foils are located along an edge of the grounded conductive foil in the plan view of the substrate.

8. The antenna according to claim 2, further comprising:

an impedance element, wherein the one end of each of the two second conductive foils is connected to the grounded conductive foil via the impedance element.

9. A wireless module comprising a communication circuit provided on the substrate of the antenna according to claim 2.

10. The antenna according to claim 1, wherein the one end of the first conductive foil and the one end of the second conductive foil are located along an edge of the grounded conductive foil in the plan view of the substrate.

11. The antenna according to claim 10, further comprising:

a wiring conductor transmitting the antenna signal, wherein the one end of the first conductive foil is connected to the wiring conductor.

12. The antenna according to claim 11, further comprising:

an impedance element, wherein the one end of each of the two second conductive foils is connected to the grounded conductive foil via the impedance element.

13. A wireless module comprising a communication circuit provided on the substrate of the antenna according to claim 11.

14. The antenna according to claim 10, further comprising:

an impedance element, wherein the one end of each of the two second conductive foils is connected to the grounded conductive foil via the impedance element.

15. A wireless module comprising a communication circuit provided on the substrate of the antenna according to claim 10.

16. The antenna according to claim 1, further comprising:

an impedance element, wherein the one end of the second conductive foil is connected to the grounded conductive foil via the impedance element.

17. A wireless module comprising a communication circuit provided on the substrate of the antenna according to claim 16.

18. A wireless module comprising a communication circuit provided on the substrate of the antenna according to claim 1.

19. The antenna according to claim 1, wherein the second conductive foil is an extension of the grounded conductive foil in the plain view of the substrate.

20. The antenna according to claim 1, wherein the grounded conductive has a recess, and the one end of the first conductive foil is disposed within the recess.

* * * * *